US007775904B2

(12) United States Patent
Hirano

(10) Patent No.: US 7,775,904 B2
(45) Date of Patent: Aug. 17, 2010

(54) WOOD-TYPE GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 12/285,074

(22) Filed: Sep. 29, 2008

(65) Prior Publication Data

US 2009/0118032 A1 May 7, 2009

(30) Foreign Application Priority Data

Nov. 7, 2007 (JP) ..... 2007-289975

(51) Int. Cl.
*A63B 53/04* (2006.01)

(52) U.S. Cl. ..... 473/332; 473/344; 473/345; 473/349; 473/338

(58) Field of Classification Search ..... 473/324–350, 473/287–292
See application file for complete search history.

(56) References Cited

U.S. PATENT DOCUMENTS 1,568,888 A * 1/1926 Dunn ..... 473/345
4,811,950 A * 3/1989 Kobayashi ..... 473/335
5,306,450 A * 4/1994 Okumoto et al. ..... 264/45.1
5,316,298 A * 5/1994 Hutin et al. ..... 473/332
5,316,305 A * 5/1994 McCabe ..... 473/332
5,421,577 A * 6/1995 Kobayashi ..... 473/335
5,570,886 A * 11/1996 Rigal et al. ..... 473/345
5,669,827 A * 9/1997 Nagamoto ..... 473/345
6,319,148 B1 * 11/2001 Tom ..... 473/290
6,440,008 B2 * 8/2002 Murphy et al. ..... 473/324
7,316,624 B2 * 1/2008 Sanchez ..... 473/345
7,462,110 B2 * 12/2008 Yamamoto ..... 473/334
2001/0055995 A1 * 12/2001 Cackett et al. ..... 473/342
2004/0087388 A1 * 5/2004 Beach et al. ..... 473/334
2006/0148587 A1 * 7/2006 Stevens et al. ..... 473/345
2007/0037633 A1 * 2/2007 Thielen ..... 473/346
2007/0129160 A1 * 6/2007 Matsunaga et al. ..... 473/332

FOREIGN PATENT DOCUMENTS

JP 2004-337303 A 12/2004

* cited by examiner

*Primary Examiner*—Sebastiano Passaniti
(74) *Attorney, Agent, or Firm*—Birch, Stewart, Kolasch & Birch, LLP

(57) ABSTRACT

A wood-type golf club head has a hollow structure comprising a face portion having a back surface and a front surface defining a club face for striking a ball, a crown portion, a sole portion, and a side portion between the crown portion and sole portion. The hollow structure is provided with a hollow and a solid part. The solid part extends forward from the backmost point of the club head by a distance of from 0.08 to 0.20 times the maximum size of the club head in the back-and-forth direction, the hollow extends between the front surface of the solid part and the back surface of the face portion. The main frame of the hollow structure integrally includes the solid part.

7 Claims, 10 Drawing Sheets

Ref. 1 & 3

Ref. 2 & 4

WOOD-TYPE GOLF CLUB HEAD

BACKGROUND OF THE INVENTION

The present invention relates to a wood-type golf club head, more particularly to a main frame structure having a hollow and a solid part capable of increasing the moment of inertia.

It is important to improve the directionality of hit balls in order to stabilize the carry distance. To deepen the center of gravity and to increase the moment of inertia of a wood-type club head are effectual for that purpose. It is therefore, effectual to place a weight member at a position far rearward from the center of gravity of the head.

The backmost point MB of a wood-type hollow club head is however, a crook in which the crown portion (f) and the side portion (g) meet as shown in FIG. 12. Therefore, it is difficult to fix a separate weight member to this part. If a heavy weight member is fixed to such a crooked part, there is a possibility that the weight member comes off due to large shocks repeated during use.

Accordingly, a weight member (b) is conventionally fixed to the sole portion (j) or side portion (g). Therefore, in order to obtain a large moment of inertia, it is necessary to increase the weight of the weight member (b) at a more degree than the backmost point MB. Thus, an unfavorable increase in the mass of the club head is inevitable.

SUMMARY OF THE INVENTION

It is therefore, an object of the present invention to provide a wood-type golf club head in which a large weight can be distributed in the rear of the club head without significantly increasing the total weight of the club head, and a large moment of inertia can be obtained in order to improve the directionality of the hit balls.

According to the present invention, a wood-type golf club head comprises:

a hollow structure comprising a crown portion, a sole portion, a side portion between the crown portion and sole portion, and a face portion having a back surface and a front surface defining a club face for striking a ball, the hollow structure provided with a hollow and a solid part, wherein the solid part extends forward from the backmost point of the club head by a distance of from 0.08 to 0.20 times the maximum size of the club head in the back-and-forth direction, the hollow extends between the front surface of the solid part and the back surface of the face portion, and a main frame of the hollow structure integrally includes the solid part.

BRIEF DESCRIPTION OF THE DRAWINGS

FIG. 5(*b*) is an enlarged cross sectional view for explaining the intersecting point between the front surface of the solid part and the inner surface of the sole portion.

DEFINITIONS

Figure 1:
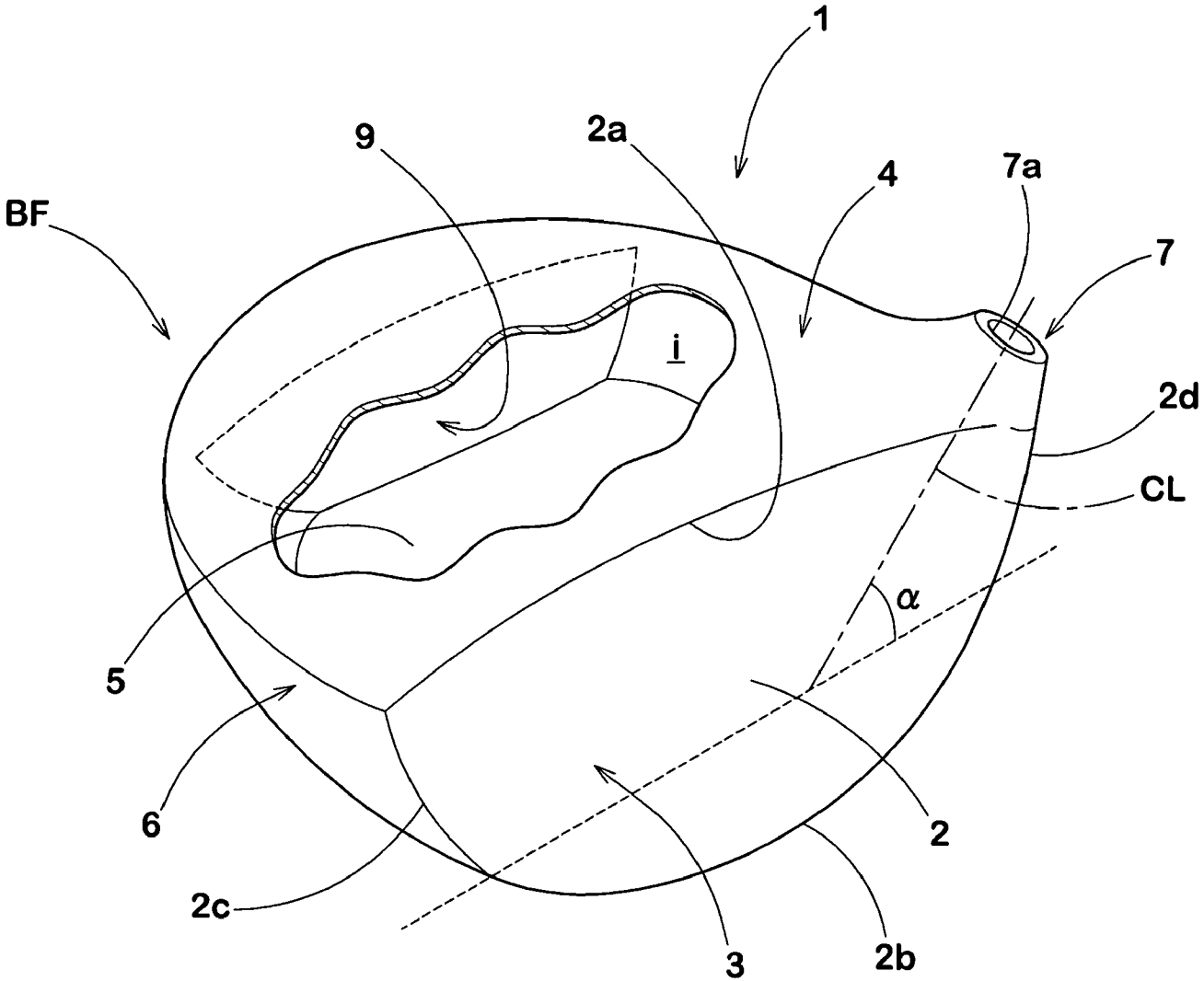
FIG. 1 is a perspective view of a wood-type golf club head according to the present invention.
Figure 2:
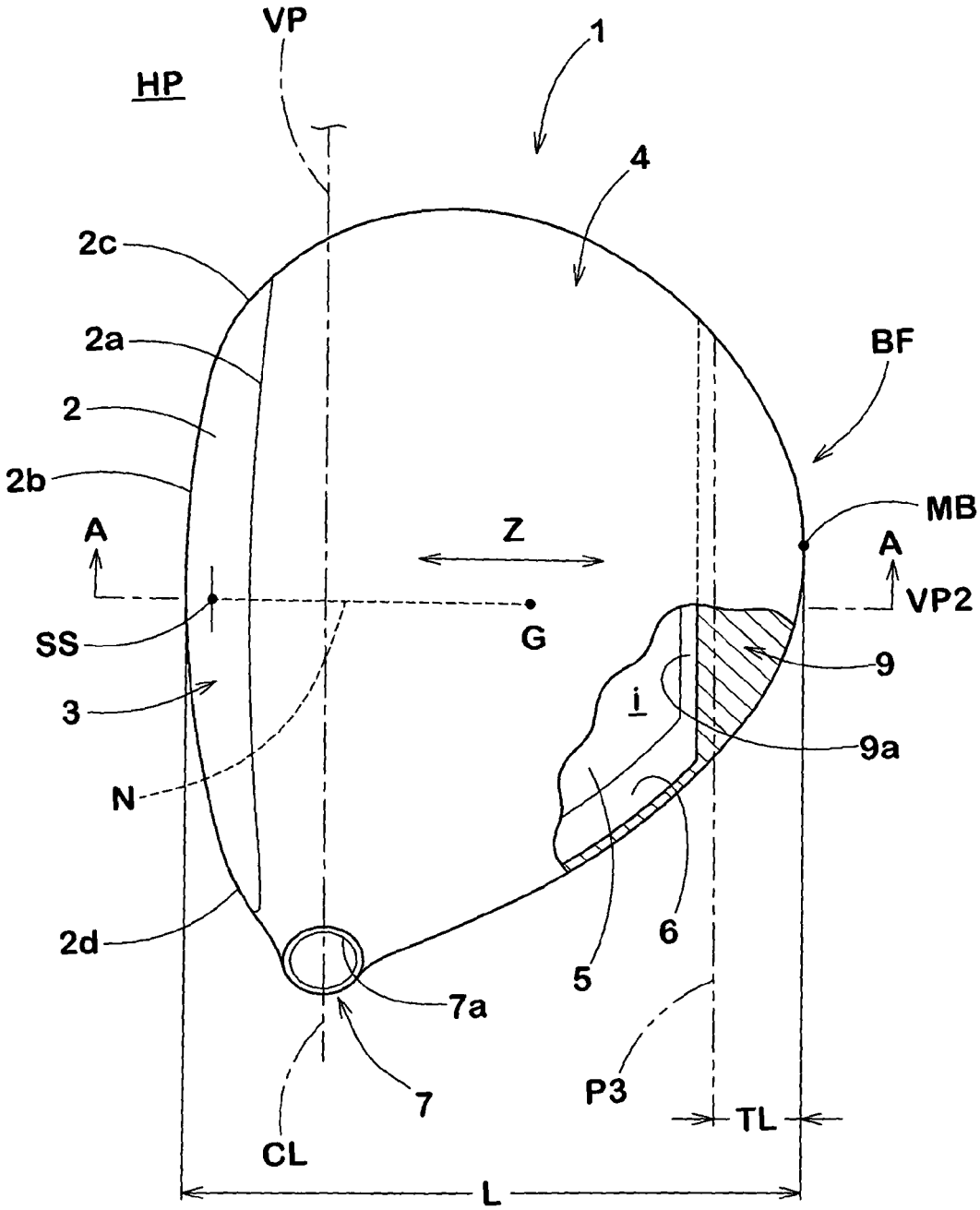
FIG. 2 is a top view thereof.

In the following description, the dimensions refer to the values measured under the standard state of the club head unless otherwise noted.

Here, the standard state of the club head 1 is such that the club head is set on a horizontal plane HP so that the axis of the club shaft(not shown) is inclined at the lie angle (alpha) while keeping the axis line on a vertical plane VP, and the club face 2 forms its loft angle (beta) with respect to the horizontal plane HP. Incidentally, in the case of the club head alone, the center line of the shaft inserting hole 7*a* can be used instead of the axis of the club shaft.

"Lateral moment of inertia" is the moment of inertia around a vertical axis passing through the center of gravity G of the head in the standard state.

"Sweet spot SS" is the point of intersection between the club face 2 and a straight line N drawn normally to the club face 2 passing the center of gravity G of the head.

"Back-and-forth direction" is a direction z parallel with the straight line N projected on the horizontal plane HP.

"Heel-and-toe direction" is a direction perpendicular to the back-and-forth direction and parallel with the horizontal plane HP.

"Up-and-down direction" is a direction perpendicular to the horizontal plane HP.

"Leading edge Le" is a contact point between the club face 2 and a vertical plane parallel with the vertical plane VP.

"Maximum size L" of the head is the horizontal distance between the leading edge Le and the backmost point MB in the back-and-forth direction.

"Depth GL of the center of gravity G" is the horizontal distance between the center of gravity G and the leading edge Le.

"Wood-type" golf club is meant for at least number 1 to 5 woods, and clubs comprising heads having similar shapes thereto may be included.

DESCRIPTION OF THE PREFERRED EMBODIMENTS

Embodiment of present invention will now be described in detail in conjunction with accompanying drawings.

In the drawings, wood-type golf club head 1 according to the present invention comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*.

The club head 1 is made of one or more metal materials, e.g. stainless steels, maraging steels, pure titanium, titanium alloys, aluminum alloys and the like.

In the case of titanium alloys, Ti-6Al-4V, Ti-15V-3Cr-3Al-3Sn, Ti-15Mo-5Zr-3Al, Ti-5.5Al-1Fe, Ti-13V-11Cr-3Al and the like can be suitably used.

The embodiment shown in FIG. 1 is made up of metal materials only. However, it is of course possible to use a fiber reinforced resin or FRP to form a part of the head 1. Further, it is also possible to combine a viscoelastic material as an absorber for the vibration of the head caused when hitting a ball.

The thickness tf of the face portion 3 is preferably set in a range of not less than 2.0 mm, more preferably not less than 2.5 mm, but not more than 4.0 mm, more preferably not more than 3.5 mm. If less than 2.0 mm, damage such as crack and dent is likely to occur in the face portion 3 by the shock at the time of hitting a ball. If more than 4.0 mm, the restitution coefficient is decrease and the carry distance is decreased.

Figure 3:
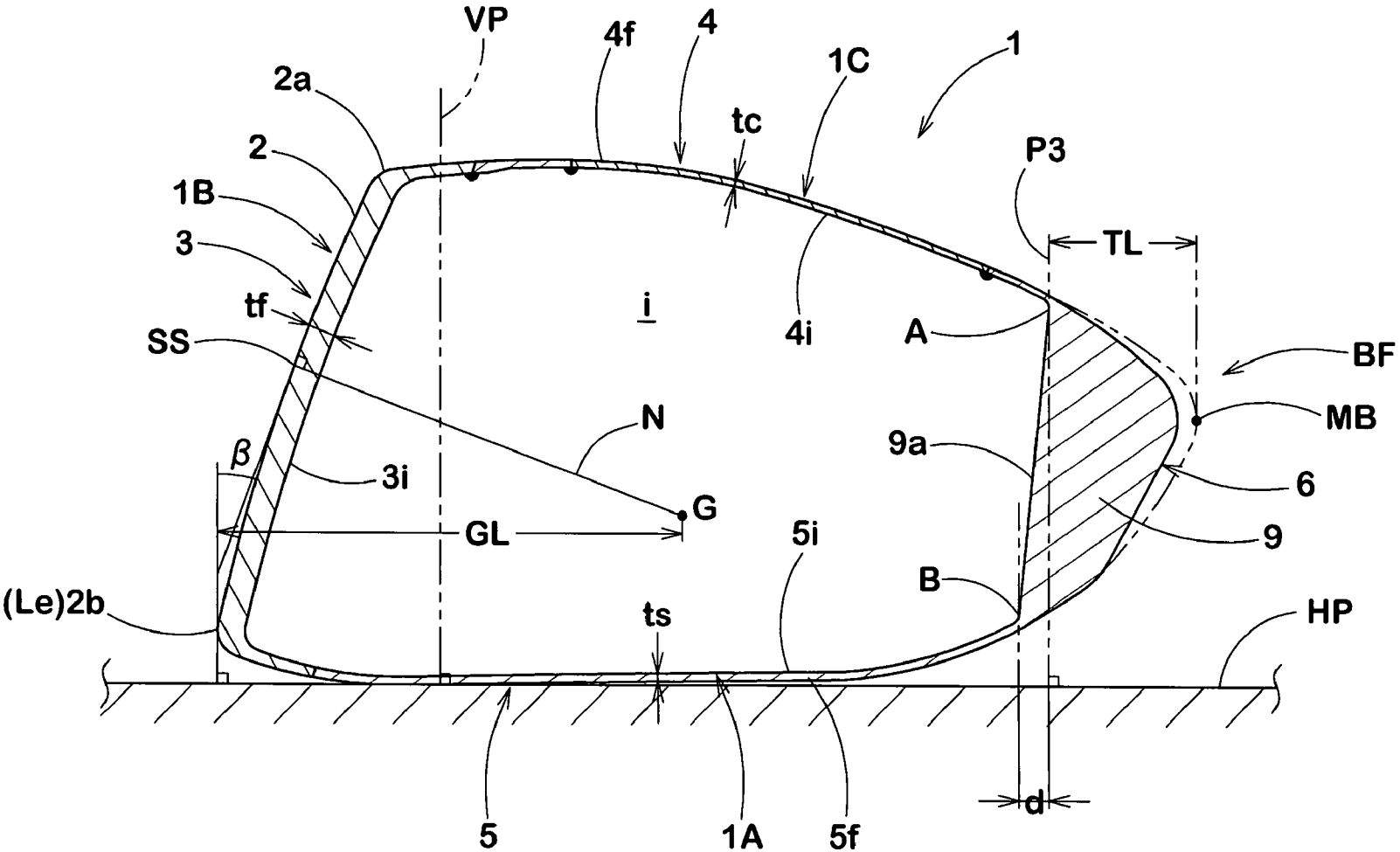
FIG. 3 is a cross sectional view taken along line A-A of FIG. 2.

The club head 1 is provided with a solid part 9 at the rear of the head as shown in FIG. 3. Thus, the hollow (i) is formed between the back surface 3*i* of the face portion 3 and the front surface 9*a* of the solid part 9.

The club head 1 can be formed by assembling a plurality of members (for example, from two to five members).

Figure 4:
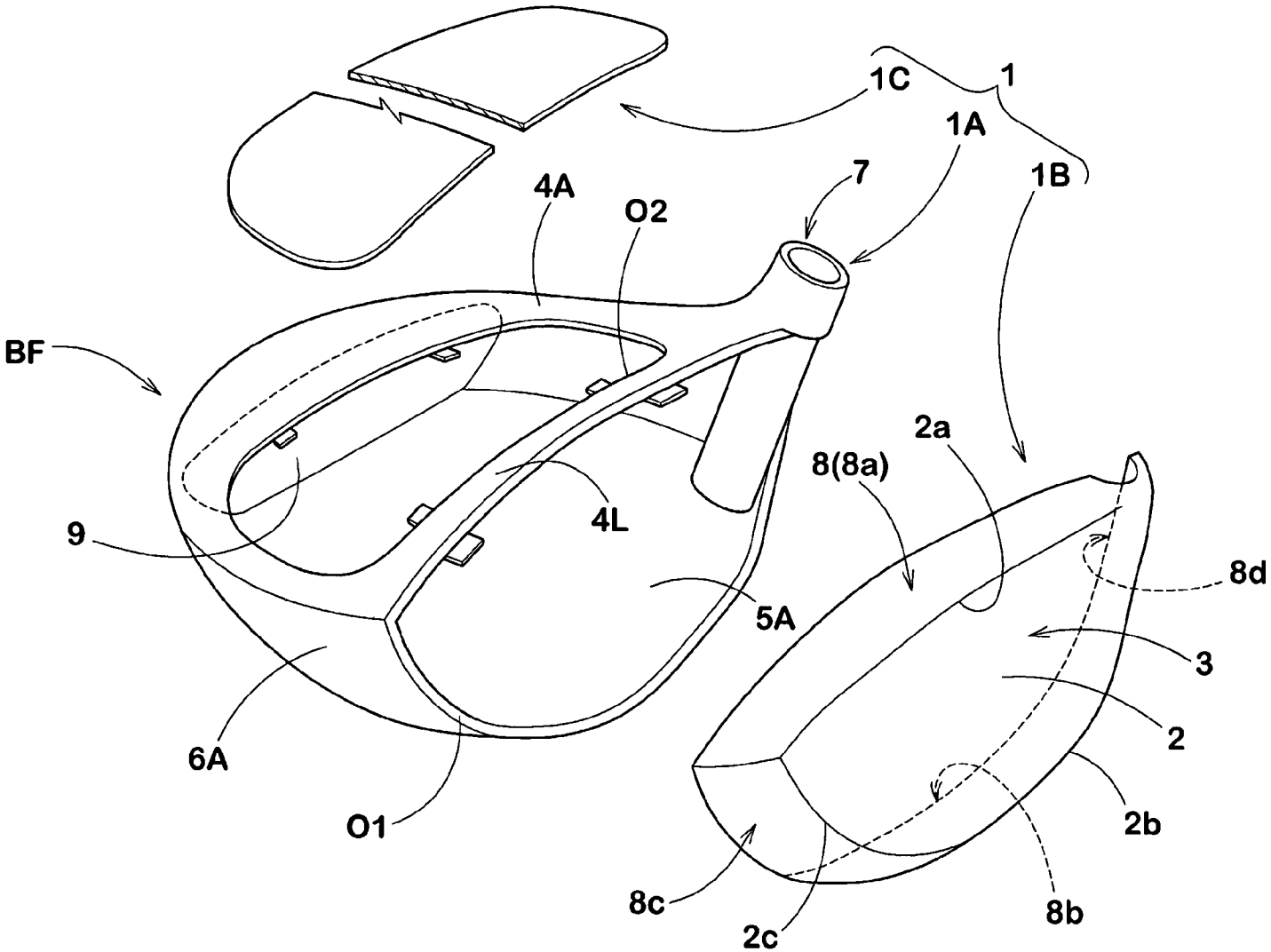
FIG. 4 is an exploded perspective view of the head.

In this embodiment, as shown in FIG. 4, the following three members are assembled: a face plate 1B made of a titanium alloy; a crown plate 1C made of a titanium alloy; and a main frame 1A made of a titanium alloy as the remaining art of the head. The main frame 1A is provided with a front opening O1 and a top opening O2 which are separated by a lateral frame 4L. The face plate 1B and the crown plate 1C cover the front opening O1 and the top opening O2, respectively.

The face plate 1B is provided with a turnback 8. The turnback 8 extends substantially continuously along the edge of the face portion 3 excepting a position corresponding to the hosel portion. Thus, the turnback 8 includes a crown-side turnback 8*a*, a sole-side turnback 8*b*, a toe-side turnback 8*c* and a heel-side turnback 8*d*. By the turnback 8, the weld junction between the face plate 1B and the main frame 1A is positioned away from the edge (2*a*-2*d*) of the club face 2, and the durability and restitution coefficient can be improved.

The crown plate 1C is a slightly curved plate not provided with a structure like the turnback 8.

Thus, the main frame 1A includes: a major part 5A of the sole portion 5; a major part 6A of the side portion 6; a peripheral part 4A of the crown portion 4 surrounding the top opening O2; the entirety of the hosel portion 7; and the solid part 9 as one integral part made of the same metal material.

Each of the members may be manufactured by various methods such as casting, rolling, forging, pressing and the like.

In this embodiment, the face plate 1B is formed by mold pressing of a rolled plate of the titanium alloy.

The crown plate 1C is formed by forging of a rolled plate of the titanium alloy.

The main frame 1A is formed by casting of the molten titanium alloy as one integral part including the solid part 9.

In the up-and-down direction of the head, the solid part 9 extends from the sole portion 5 to the crown portion 4.

In the heel-and-toe direction of the head, the solid part 9 extends from the heel-side part to the toe-side part of the side portion 6.

In the back-and-forth direction of the head, the solid part 9 extends from the backmost point MB of the club head towards the face portion 3 to a position P3 at a distance TL of at least 0.08 times but at most 0.20 times the maximum size L of the head in the back-and-forth direction.

In other words, there is no hollow in a region between 0% and 8% of the maximum size L from the backmost point MB, and the hollow (i) extends backwardly to at least the position P3 at 20% of the maximum size L from the backmost point MB.

Preferably, the distance TL of the position P3 is not less than 0.10 times, more preferably not less than 0.12 times, but not more than 0.18 times, more preferably not more than 0.15 times the maximum size L. If the distance TL is less than 0.08 times the size L, it is difficult to increase the moment of inertia and the depth of the center of gravity of the head. If more than 0.20 times, there is a possibility that the rigidity of the club head is increased and the restitution coefficient is decreased.

In this embodiment, the front surface 9*a* is substantially flat and inclined backward. This helps to lower the center of gravity, and also helps to increase the area of the inner surface of the crown portion. Thus, the crown portion 4 is relatively easily bent at impact to improve the restitution coefficient of the head. More specifically, as show in FIG. 3 which shows the cross section along the second vertical plane VP2 defined as including the center of gravity G and sweat spot SS, it is preferable that the intersecting point B between the front surface 9*a* of the solid part 9 and the inner surface of the sole portion 5*i* is positioned on the front side of the intersecting point (A) between the front surface 9*a* of the solid part 9 and the inner surface of the crown portion 4*i*.

In view of the above advantageous effect, the distance (d) in the back-and-forth direction between the intersecting points A and B is preferably not less than 1 mm, more preferably not less than 2 mm, still more preferably not less than 4 mm. If the distance (d) is excessively increased, on the other hand, there is a tendency that the stress at impact concentrates at the intersecting point (A), therefore, the distance (d) is preferably not more than 10 mm, more preferably not more than 8 mm, still more preferably not more than 6 mm.

The thickness tc of the part 4*f* of the crown portion 4 between its outer surface and the inner surface facing the hollow (i) is less than the thickness tf of the face portion 3 and preferably not less than 0.3 mm but less than 2.0 mm. If the thickness tc is less than 0.3 mm, there is a possibility that the durability is deteriorated. If the thickness tc is more than 2.0 mm, there is a possibility that the center of gravity of the head becomes unfavorably high. Further, it becomes difficult to increase the restitution coefficient and the dynamic loft angle at impact. Thus, an improvement in the carry distance can not be expected.

The thickness ts of the part 5*f* of the sole portion 5 between its outer surface and the inner surface facing the hollow (i) is less than the thickness tf of the face portion 3 and preferably not less than 0.5 mm but less than 4.0 mm. If the thickness ts is less than 0.5 mm, there is a possibility that the durability is deteriorated. If the thickness ts is more than 4.0 mm, the mass of the club head is increased and there is possibility that the design freedman of the center of gravity is restricted.

Figure 5A:
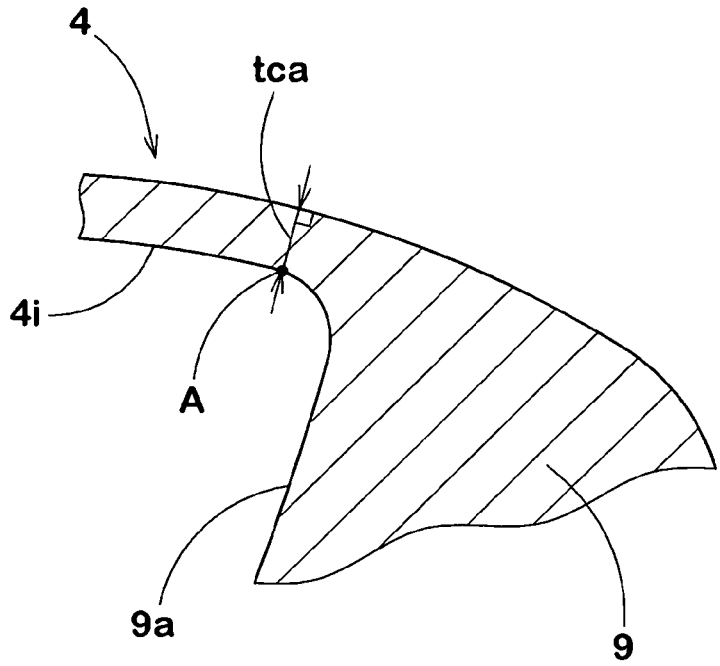
FIG. 5(*a*) is an enlarged cross sectional view for explaining the intersecting point between the front surface of the solid part and the inner surface of the crown portion.
Figure 5B:
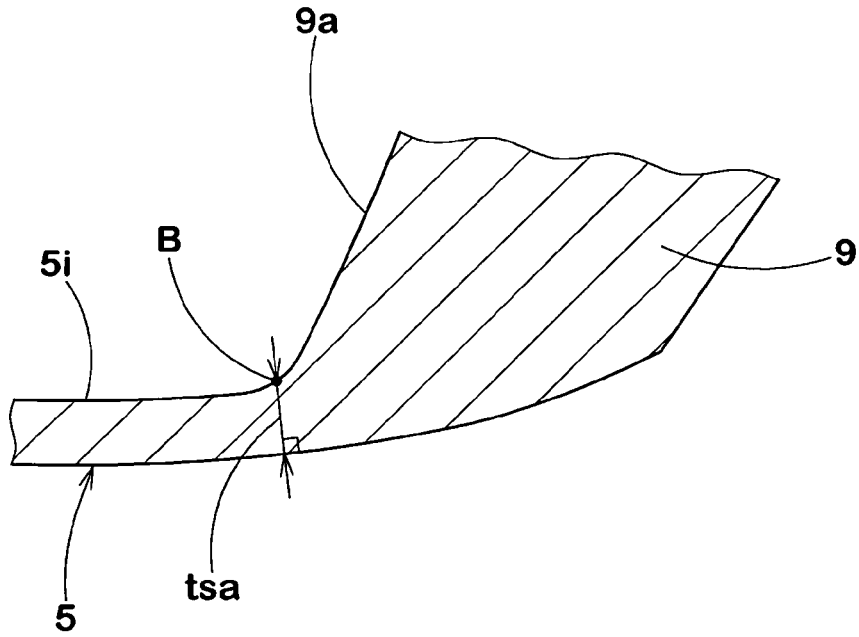

In relation to the thickness tc and ts, if the intersecting points A and B are unclear due to rounding or chamfer, as shown in FIG. 5(*a*), the intersecting point (A) is defined as a position on the inner surface of the club head at which the thickness tca measured perpendicularly to the outer surface of the crown portion 4 becomes 2.0 mm, and the intersecting point B is defined as a position on the inner surface of the club head at which the thickness tsa measured perpendicularly to the outer surface of the sole portion 5 becomes 4.0 mm as shown in FIG. 5(*b*).

In the case that the solid part 9 is formed as above, since the wall thickness surrounding the solid part 9 is relatively very small, due to the inertia of the solid part 9, the head is liable to vibrate by the shock when hitting a ball. If the duration time of the vibration is long, the above-mentioned intersecting points A and B are liable to fatigue during use. Therefore, in such a case, it is preferable that a vibration absorber 10 is disposed in the sole portion 5 or crown portion 4.

Figure 6:
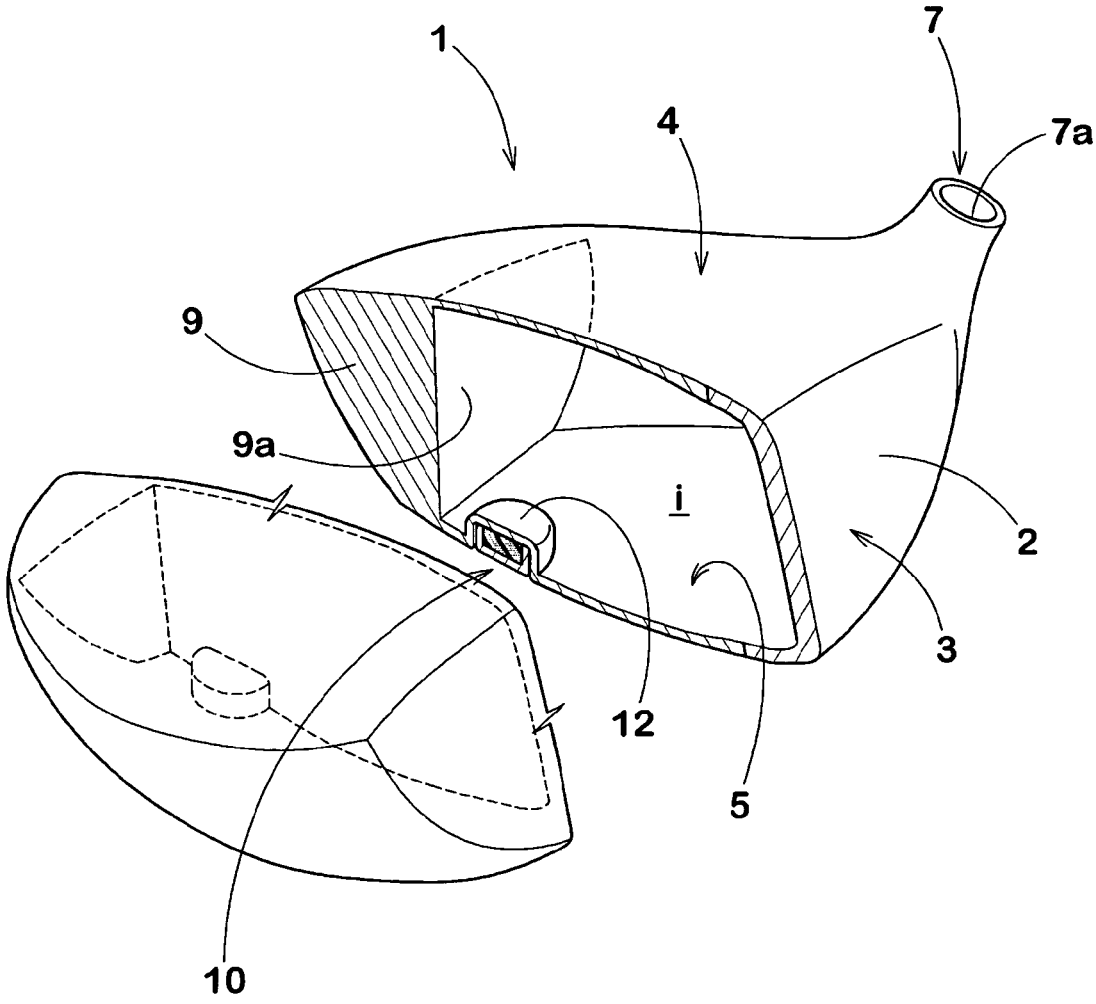
FIG. 6 is a perspective view of another embodiment of present invention provided with a vibration absorber cut into two along a plane VP2.
Figure 7:
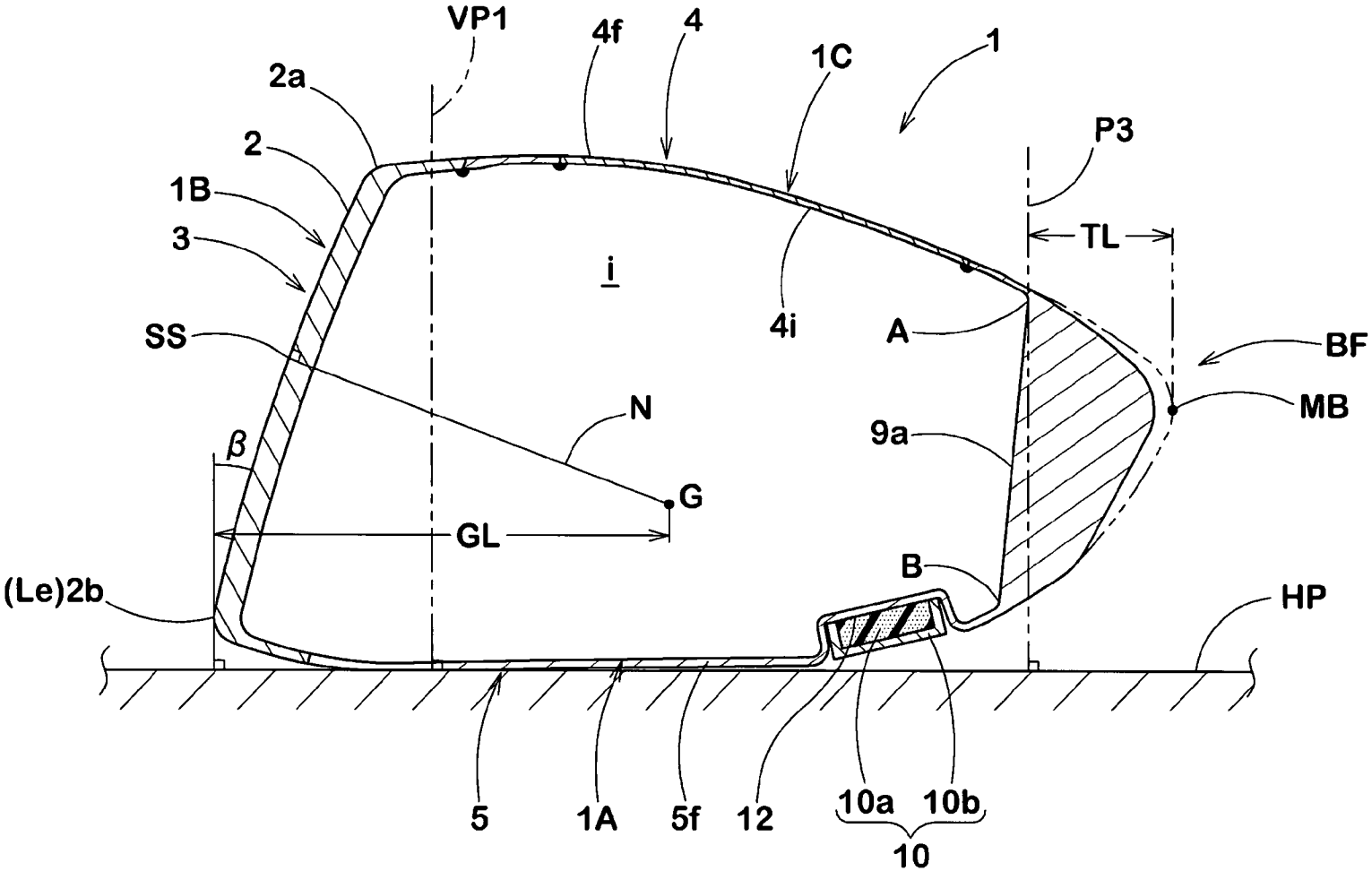
FIG. 7 is a cross sectional view thereof taken along the plane VP2 or a line corresponding to line A-A of FIG. 2.
Figure 8:
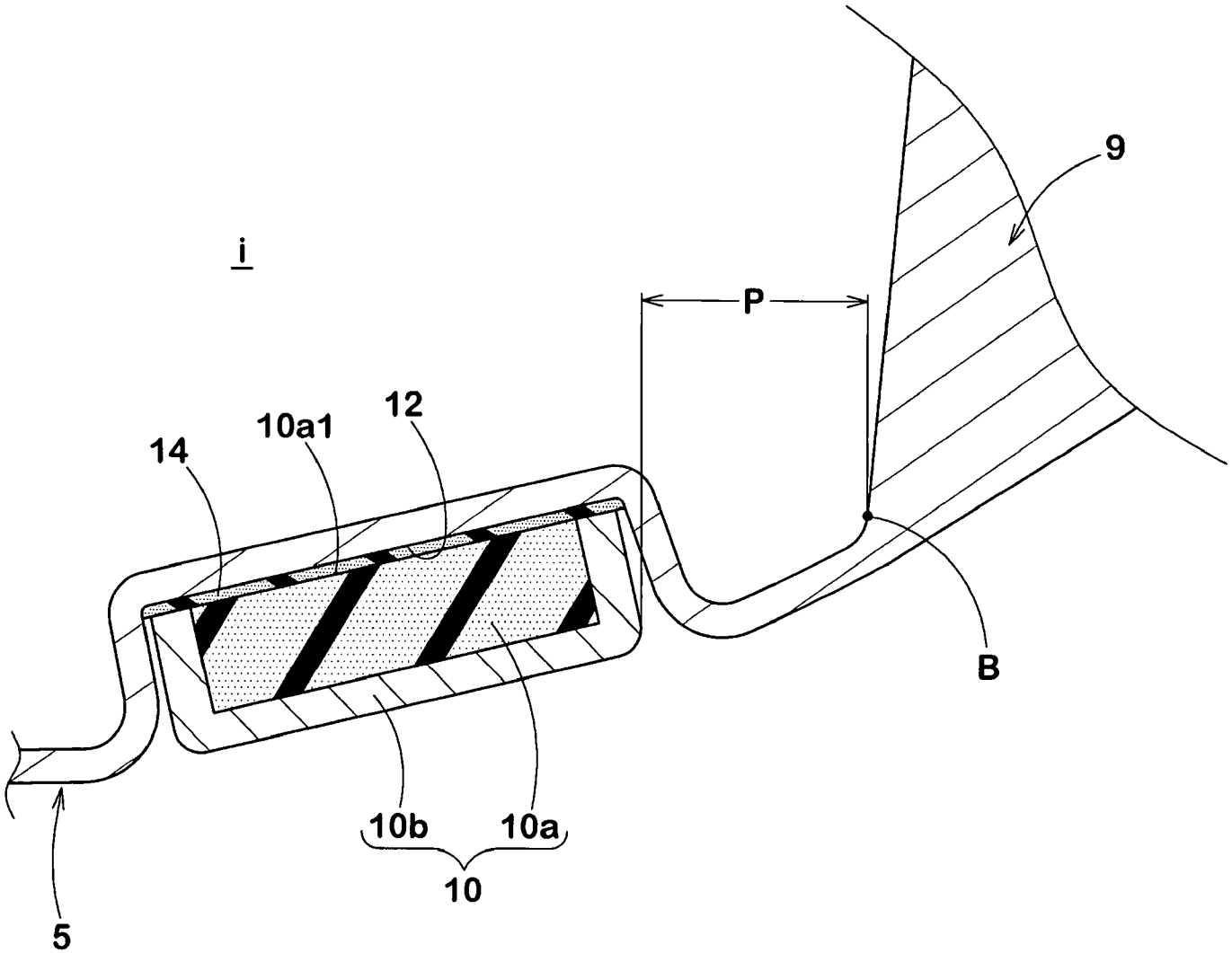
FIG. 8 is an enlarged cross sectional view of the vibration absorber.

In the wood-type golf club head shown in FIGS. 6 to 8, the vibration absorber 10 is disposed in the sole portion 5. In this embodiment, the outer surface of the sole portion 5 is provided with a cylindrical recess 12 in order to provide accommodation for the vibration absorber 10.

The vibration absorber 10 is made up of a soft part 10*a* made of a viscoelastic material and a hard part 10*b* made of a metal material.

Figure 9:
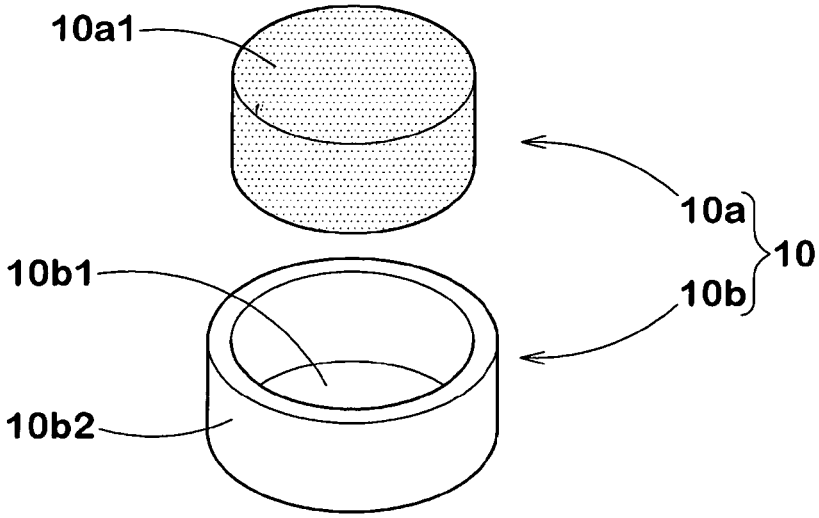
FIG. 9 is a perspective view of the vibration absorber.
Figure 10:
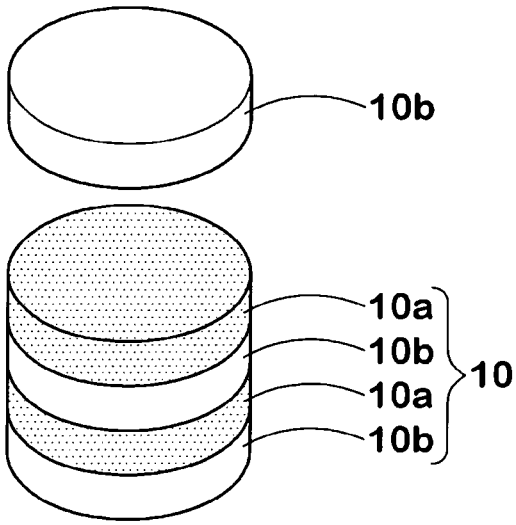
FIGS. 10 and 11 are perspective views each showing another example of the vibration absorber.
Figure 11:
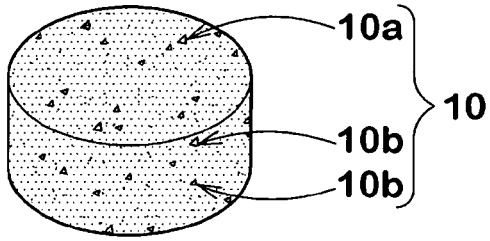

FIGS. 9, 10 and 11 each show an example of such vibration absorber 10.

In the example of FIG. 9, the soft part 10*a* has a shape substantially columnar with a small height.

The hard part 10*b* comprises: a tubular annular side wall 10*b*2 having a hole accommodated to the soft part 10*a*; and a bottom wall 10*b*1 closing one of the ends of the hole, and the other end is opened. The soft part 10*a* put in the hole of the hard part 10*b* is closely contacted with the hard part 10*b*. The soft part 10*a* and hard part 10*b* are fixed to each other in one body by the use of an adhesive agent.

As shown in FIG. 8, the surface 10*a*1 of the soft part 10*a* exposed at the one end of the hole and the end surface of the side wall 10*b*2 of the hard part 10*b* are fixed to the bottom surface of the recess 12 by the use of an adhesive agent 14

As to the shape of the vibration absorber 10, aside from the above-mentioned columnar shape, various shapes, e.g. a rectangular column, a plate extending in the toe-heel direction and the like are possible.

In the example shown in FIG. 10, the vibration absorber 10 has a laminated structure, wherein the platy soft parts 10*a* and platy hard parts 10*b* alternate. These parts 10*a* and 10*b* are adhered each other into one body.

In the example shown in FIG. 11, the vibration absorber 10 is such that the hard part 10*b* granulated is dispersed in the soft part 10*a*.

For the soft part 10*a*, various viscoelastic materials may be used. But, preferably, polymer materials, e.g. vulcanized rubbers, elastomer resins, thermoplastic polyester elastomers comprising a hard segment and a soft segment bound to each other, can be used alone or in combination namely as a mixture. Especially, a polymer alloy of two or more polymers mixed or chemically bonded is preferably used. For example, styrene-base thermoplastic elastomers available from Mitsubishi Chemical corporation as product name Rabalon SJ4400N, SJ5400N, SJ6400N, SJ7400N, SJ8400N, SJ9400N, SR04 can be suitably used as the polymer alloy.

If the soft part 10*a* is hard, it is difficult to effectively absorb the vibrations. If the soft part 10*a* is too soft, it is difficult to provide a necessary durability. Therefore, the hardness of the soft part 10*a* (durometer A hardness measured according to JIS-K6253) is preferably not less than 40, more preferably not less than 50, but not more than 95, more preferably not more than 90, still more preferably not more than 80.

For the hard part 10*b*, preferably used is a metal material superior in the damping factor to the main frame 1A such as Mn alloys, Ni—Ti alloys, Fe—Al alloys, Mg alloys and Mg. In the case of Mn alloys, preferably used are those comprising 17 to 27 wt % Cu, 2 to 8 wt % Ni, 1 to 3 wt % Fe, the balance being essentially Mn, and incidental impurities.

In the case of Fe—Al alloys, those comprising not less than 50 wt % Fe, and 5 to 15 wt % Al are preferably used.

It is preferable that the logarithmic decrement (δ) of such metal material is not less than 0.21, preferably not less than 0.25, more preferably not less than 0.35.

If the logarithmic decrement is less than 0.21, it is difficult to obtain a sufficient vibration controlling effect.

In view of the vibration controlling effect, it is not necessary to set the upper limit of the logarithmic decrement (δ).

However, for the practical reasons, e.g. availability, material cost and the like, the logarithmic decrement may be limited to not more than 0.90, usually not more than 0.70.

The logarithmic decrement is measured according to the Japanese Industrial standard JIS-G0602 "Test methods for vibration-damping property in laminated damping steel sheets of constrained type", using a 1 mm×10 mm×160 mm specimen at room temperature and a vibration amplitude of $5\times10^{-4}$.

Therefore, the vibration energy is consumed by the absorber 10 and transformed into heat, and the vibration is damped. As a result, the metal fatigue is prevented and the durability is improved. Further, there is a possibility that the impact feeling is improved since disagreeable vibration is reduced.

In the above-mentioned examples shown in FIGS. 9-11, both of the soft part 10*a* and hard part 10*b* are used. In general, the soft part 10*a* exerts a good ability to absorb vibrations of a relatively low frequency range, and the hard part 10*b* exerts a good ability to absorb vibrations of a relatively high frequency range. Therefore, the vibration absorber 10 can exhibit a good absorbing ability on a wide range of vibrations. Nevertheless, the soft part 10*a* alone or the hard part 10*b* alone may be used as the vibration absorber 10.

In any case, it is desirable that, in order to prevent damage, the vibration absorber 10 is completely within the recess 12 not to protrude from the outer surface of the club head as shown in FIG. 8. In the case of the example shown in FIG. 8, since the soft part 10*a* is protected by the hard part 10*b*, a very soft material can be used for the soft part 10*a*, therefore, it is possible to further improve the vibration absorbing ability.

The vibration absorbing ability is decreased as the distance between the vibration absorber 10 and the solid part 9 is increased. Therefore, the shortest distance P measured in the horizontal direction between the vibration absorber 10 and the front surface 9*a* of the solid part 9 is set to be not more than 21 mm, preferably not more than 17 mm, more preferably not more than 15 mm. If the distance P exceeds 21 mm, a significant decrease of the vibration absorbing ability is observed.

Utilizing the mass of the solid part 9, the lateral moment of inertia of the head can be easily increased.

The lateral moment of inertia is preferably not less than 5000 g sq.cm, more preferably not less than 5300 g sq.cm, still more preferably not less than 5500 g sq.cm. To comply with golf rules, the upper limit of the lateral moment of inertia is not more than 5900 g sq.cm.

Also, the depth of the center of gravity GL is preferably set to be not less than 40 mm, more preferably not less than 43 mm, but not more than 60 mm, more preferably not more than 55 mm.

It is not critical but preferable in view of the moment of inertia and the depth of the center of gravity that the volume of the club head 1 is not less than 300 cc, more preferably not less than 400 cc, still more preferably not less than 425 cc. If the volume is too large, on the other hand, the durability is decreased. Therefore, and to comply with golf rules, the volume is at most 470 cc, preferably not more than 460 cc.

If the maximum size L of the club head in the back-and-forth direction is decreased, there is possibility that a large stress concentrates at the intersecting points A and B when hitting the ball. Therefore, the maximum size L is preferably not less than 100 mm, more preferably not less than 110 mm, still more preferably not less than 115 mm. If the maximum length L is too large, on the other hand, the mass of the club head is unfavorably increased. Therefore, and to comply with golf rules, the maximum size L is not more than 127 mm.

If the total mass of the club head is too light, the moment of inertia can not be increased, and the kinetic energy of the club head becomes small, and the carry distance is decreased. Therefore, the mass of the club head is preferably not less than 180 g, more preferably not less than 185 g, still more preferably not less than 190 g, but not more than 210 g, more preferably not more than 205 g.

Comparison Tests

Wood-type golf club heads (volume: 460 cc, Loft: 11.5 deg., Lie: 58.0 deg.) having the specifications shown in Table 1 were manufactured by laser welding three members: a main frame formed by lost-wax casting of Ti-6Al-4V; a crown plate formed by forging of Ti-15V-3Cr-3Al-3Sn; and a face plate formed by mold pressing of Ti-5.5Al-1Fe.

In order to make Ex.1 to Ex.6 and Ref.1 to Ref.2 the same weight, the thickness of the sole portion was changed.

Figure 12:
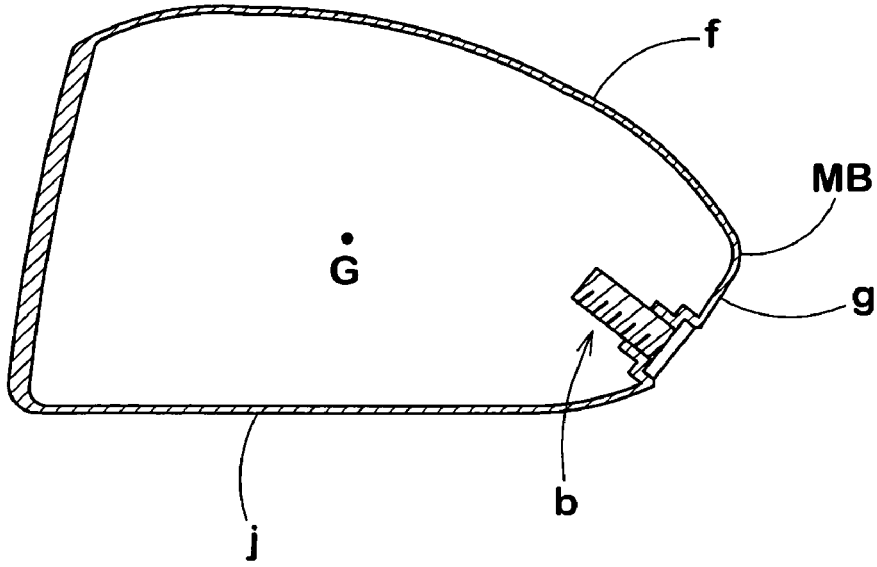
FIG. 12 is a cross sectional view of a club head structure employed in Ref.1 and Ref.3 in the undermentioned comparison tests.

Ref.1 and Ref.3: As shown in FIG. 12, instead of the solid part 9, a weight member (b) in the form of a screw bolt was screwed. The weight member was made of a sintered W—Ni alloy comprising 58 wt % W, 39 wt % Ni, 3 wt % Fe and incidental impurities, and the specific gravity was 14.0. The main frame of Ref.3 was thicker than the main frame of Ref.1, and the moment of inertia of Ref.3 was larger than that of Ref.1.

Figure 13:
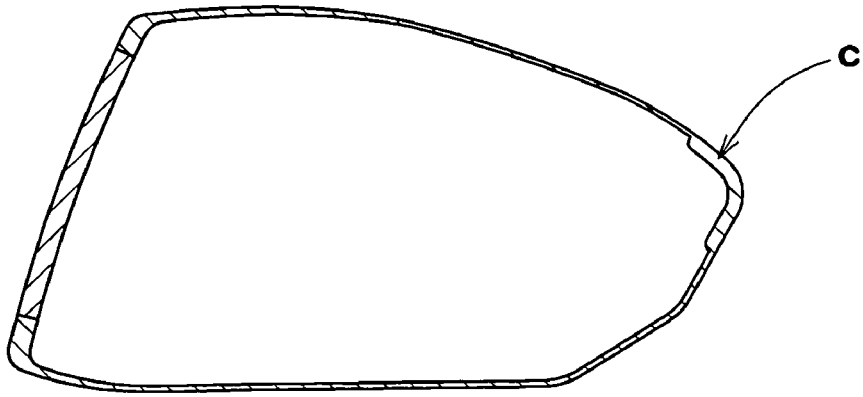
FIG. 13 is a cross sectional view of a club head structure employed in Ref.2 and Ref.4 in the undermentioned comparison tests.

Ref.2 and Ref.4: AS shown in FIG. 13, instead of forming the solid part 9, the wall thickness was increased in the crook (c) in which the crown portion and the side portion meet. The main frame of Ref.4 was thicker than the main frame of Ref.2.

TABLE 1

| Head | Ex. 1 | Ex. 2 | Ex. 3 | Ex. 4 | Ex. 5 | Ex. 6 | Ref. 1 | Ref. 2 | Ref. 3 | Ref. 4 |
|---|---|---|---|---|---|---|---|---|---|---|
| Structure | FIG. 3 | FIG. 3 | FIG. 3 | FIG. 3 | FIG. 3 | FIG. 3 | FIG. 12 | FIG. 13 | FIG. 12 | FIG. 13 |
| L (mm) | 118 | 118 | 118 | 118 | 118 | 118 | 118 | 118 | 118 | 118 |
| TL (mm) | 10.5 | 11.5 | 13.6 | 15.2 | 14.5 | 12.6 | — | — | — | — |
| TL/L | 0.09 | 0.10 | 0.12 | 0.13 | 0.12 | 0.11 | — | — | — | — |
| d (mm) | 6.7 | 6.0 | 4.7 | 3.5 | 2.5 | 4.5 | — | — | — | — |
| Mass of head (g) | 195 | 195 | 195 | 195 | 195 | 195 | 195 | 195 | 205 | 203 |
| GL (mm) | 41.9 | 43.5 | 44.5 | 48.1 | 45.8 | 45.5 | 39.8 | 40.9 | 46.9 | 47.3 |
| Moment of inertia (g sq.cm) | 5060 | 5180 | 5320 | 5590 | 5450 | 5420 | 4470 | 4710 | 5590 | 5650 |

As shown in Table 1, the club heads according to the present invention can be increased in the moment of inertia and the depth GL of the center of gravity without increasing the total mass of the club head.

Further, in order to evaluate the effect of the vibration absorber on the metal fatigue or the durability of the head, club heads Ex.7 to Ex.14 as shown in FIG. 7 were prepared. All of the vibration absorbers were the type shown in FIG. 9, wherein the soft part was made of a columnar silicon rubber (GE Toshiba "Silicon 50") having a diameter 15 mm and a height 5 mm, and the hard part was made of a Mg alloy (Mg-3Al-1Zn).

The vibration absorber was fixed to the main frame, using an adhesive agent (Sumitomo 3M "DP420").

In order to make Ex.7 to Ex.14 the same weight, the thickness of the sole portion was changed.

The heads were tested for the durability as follow:

The club heads were attached to identical FRP shafts to make 45-inch wood clubs, and each golf club was mounted on a swing robot. Then, the head hit golf balls 10,000 times (max) at the head speed of 54 meter/second, while visually checking the outer appearance every 100 times.

The results are shown in Table 2, wherein "A" means that no damage was found after the 10000-time hitting test, and numerical values mean the number of hitting times at which a damage was observed.

TABLE 2

| Head | Ex. 6 | Ex. 7 | Ex. 8 | Ex. 9 | Ex. 10 | Ex. 11 | Ex. 12 | Ex. 13 | Ex. 14 |
|---|---|---|---|---|---|---|---|---|---|
| Structure | FIG. 3 | FIG. 7 | FIG. 7 | FIG. 7 | FIG. 7 | FIG. 7 | FIG. 7 | FIG. 7 | FIG. 7 |
| L (mm) | 118.00 | 118 | 118 | 118 | 118 | 118 | 118 | 118 | 118 |
| TL (mm) | 12.6 | 10.5 | 11.5 | 13.6 | 15.2 | 14.5 | 13.0 | 12.5 | 12.7 |
| TL/L | 0.11 | 0.09 | 0.10 | 0.12 | 0.13 | 0.12 | 0.11 | 0.11 | 0.11 |
| d (mm) | 4.5 | 6.7 | 6.0 | 4.7 | 3.5 | 2.5 | 4.0 | 4.0 | 4.0 |
| Mass of head (g) | 195 | 198 | 198 | 198 | 198 | 198 | 198 | 198 | 198 |
| GL (mm) | 45.5 | 42.6 | 44.8 | 46.8 | 50.2 | 47.5 | 45.9 | 45.2 | 45.5 |
| Moment of inertia (g sq.cm) | 5420 | 5170 | 5310 | 5540 | 5820 | 5640 | 5410 | 5370 | 5395 |
| Vibration absorber | non | FIG. 9 | FIG. 9 | FIG. 9 | FIG. 9 | FIG. 9 | FIG. 9 | FIG. 9 | FIG. 9 |
| P (mm) | — | 16.5 | 15.0 | 15.0 | 12.5 | 8.4 | 31.2 | 27.0 | 20.8 |
| Durability | 4849* | A | A | A | A | A | 5870* | 7530* | 9310* |

*Damage occurred in the vicinity of the intersecting point B between the front surface of the solid part and the inner surface of the sole portion.

As shown in Table 2, it was confirmed that the vibration absorber can improve the durability. Especially, such effect is remarkable when the distance P between the vibration absorber and solid part is less than 17 mm.

In Table 1 and Table 2, the lateral moment of inertia was measured with "Moment of Inertia Measuring Instrument MODEL NO. 005-002, INERTIA DYNAMICS Inc."

The invention claimed is:

1. A wood-type golf club head comprising:

a hollow structure comprising a crown portion, a sole portion, a side portion between the crown portion and sole portion, and a face portion having a back surface and a front surface defining a club face for striking a ball, the hollow structure provided with a hollow and a solid part, wherein the solid part extends forward from the backmost point of the club head to a position at a distance of from 0.08 to 0.20 times the maximum size of the club head in the back-and-forth direction, the hollow extends between the front surface of the solid part and the back surface of the face portion, and a main frame of the hollow structure integrally includes said solid part, an outer surface of the sole portion is provided with a recess, a vibration absorber is disposed in the recess, the vibration absorber is composed of a soft part made of a viscoelastic material and a hard part made of a metal material, the hard part comprises:

a tubular annular side wall having a hole, one end of which is opened, and a bottom wall closing the other end of the hole, the soft part is put in the hole of the hard part and in close contact with the hard part, and the soft part is fixed to a bottom surface of the recess by the use of an adhesive agent, the shortest distance between the vibration absorber and the front surface of the solid part measured in the horizontal direction is not more than 21 mm, and the lateral moment of inertia of the head is not less than 5300 g sq.cm and not more than 5900 g sq.cm.

2. The club head according to claim 1, wherein the front surface of the solid part is inclined backward.

3. The club head according to claim 1, wherein the volume of the club head is not less than 300 cc.

4. The club head according to claim 1, wherein said maximum size of the club head in the back-and-forth direction is not less than 100 mm.

5. The club head according to claim 1, wherein the metal material of the hard part is made of one of Mn alloys, Ni—Ti alloys, Fe—Al alloys, Mg alloys and Mg.

6. The club head according to claim 1, wherein the volume of the club head is not less than 300 cc, said maximum size of the club head in the back-and-forth direction is not less than 100 mm, and the metal material of the hard part is made of one of Mn alloys, Ni—Ti alloys, Fe—Al alloys, Mg alloys and Mg.

7. The club head according to claim 6, wherein the front surface of the solid part is substantially flat and inclined backward.

* * * * *